US006021988A

United States Patent [19]

Frank et al.

[11] Patent Number: 6,021,988

[45] Date of Patent: Feb. 8, 2000

[54] HOUSING PAN FOR SUPPORTING A FLUID DELIVERY PUMP

[75] Inventors: Kurt Frank, Schorndorf; Michael Huebel, Gerlingen; Ulrich Projahn, Leonberg, all of Germany

[73] Assignee: Robert Bosch GmbH, Stuttgart, Germany

[21] Appl. No.: 09/027,606

[22] Filed: Feb. 23, 1998

[30] Foreign Application Priority Data

Apr. 18, 1997 [DE] Germany ..... 197 16 175

[51] Int. Cl.[7] ..... B65D 1/34

[52] U.S. Cl. ..... 248/346.03; 137/571

[58] Field of Search ..... 248/346.03, 672, 248/678, 346.01, 346.2, 346.5; 220/571, 630, 636; 137/571, 150

[56] References Cited

U.S. PATENT DOCUMENTS

| | | | |
|---|---|---|---|
| 875,944 | 1/1908 | Nash | 220/571 |
| 1,594,248 | 7/1926 | Epstathiou | 62/400 |
| 2,258,155 | 10/1941 | Watson | 494/49 |
| 3,069,671 | 12/1962 | Taylor | 340/616 |
| 3,788,581 | 1/1974 | Rutzick | 248/678 |
| 4,085,773 | 4/1978 | Tinney | 137/571 |
| 4,765,360 | 8/1988 | Baird | 137/312 |
| 4,862,909 | 9/1989 | Kim | 137/150 |
| 4,907,713 | 3/1990 | Stempin | 220/630 |
| 5,096,087 | 3/1992 | Thomas | 220/561 |
| 5,099,873 | 3/1992 | Sanchez | 137/312 |
| 5,134,683 | 7/1992 | Powell | 392/449 |
| 5,836,554 | 11/1998 | Lesage | 248/152 |

FOREIGN PATENT DOCUMENTS

| | | |
|---|---|---|
| 2 655 688 | 6/1991 | France . |
| 32 25 929A1 | 1/1984 | Germany . |
| 37 19 808 C1 | 5/1988 | Germany . |
| 43 36 573 A1 | 5/1995 | Germany . |
| 44 44 854 A1 | 6/1996 | Germany . |

*Primary Examiner*—Ramon O. Ramirez
*Assistant Examiner*—Anita M. King

[57] ABSTRACT

A housing pan for receiving a fluid delivery pump for a delivery aggregate for delivering fuel from a fuel tank has a pan body, a unit forming a supply opening for flowing fluid and open into an interior of the pan body, a pan bottom, a unit forming a part-ring shaped flow passage located concentrically into an axis of a pan body in an interior of the pan body at an axial distance from the pan body, the flow passage having a passage entry which communicates with the supply opening and also having a passage wall which is located inwardly in a radial direction and is provided with a plurality of throughgoing slots, the throughgoing slots being spaced from one another over a length of the flow passage and extending in a longitudinal direction of the flow passage, the throughgoing slots having lower slot edges located closer to the pan bottom and arranged at least near a passage bottom.

18 Claims, 6 Drawing Sheets

HOUSING PAN FOR SUPPORTING A FLUID DELIVERY PUMP

BACKGROUND OF THE INVENTION

The present invention relates to a housing pan for supporting a fluid delivery pump, in particular for a delivery aggregate for delivering fuel from a fuel tank.

A known delivery aggregate of the above mentioned type for delivering fuel from a fuel tank is disclosed in the German patent document DE 44 44 854 A1. In this aggregate the delivery of fuel pump is arranged in a filter pan which is inserted in the housing pan closed with the flange from the upper side. This complete mounting unit known as an assembly unit is inserted in the fuel tank of a motor vehicle and mounted on its bottom. The housing pan is always filled with fuel from the inner chamber of the tank through a supply opening the fuel pump aspirates fuel from the housing pan through a filter arranged at its suction side in the filter pan and pumps it to the internal combustion engine through a delivery conduit which is connected at its pumping side. A consumed fuel which is not consumed flows through a return conduit again to the housing pan. The fuel return flow is used also for operation of a suction jet pump which delivers the fuel from the fuel tank into the housing pan through the supply opening, so that the fuel level in the housing pan is always maintained at the same level, even when the fuel level in the fuel tank is lowered below it.

SUMMARY OF THE INVENTION

Accordingly, it is an object of the present invention to provide a housing pan for supporting a fluid delivery pump, which avoids the disadvantages of the prior art.

More particularly, it is an object of present invention to provide a housing pan for supporting a fluid delivery pump which has the advantage that dirt particles contained in the fluid are efficiently withdrawn and retained far from the suction side of the fluid pump, so that the conventionally available filter is not dirtied fast and a filter exchange for exchanging the clogged filter is needed only in substantial time intervals.

In keeping with these objects and with others which will become apparent hereinafter, one feature of present invention resides, briefly stated, in a housing pan of the above mentioned type, in which a partially ring-shaped flow passage is formed in the interior of the pan at an axial distance from a pan bottom, a passage entry communicates with the supply opening, and a passage wall located inwardly in a radial direction has a plurality of throughgoing slots which are arranged so that they are spaced from one another over a passage length and extend in a longitudinal direction of the passage, and the throughgoing slots have slot edges which are located closer to the pan bottom and arranged on or near the passage bottom.

When the housing pan for supporting a fluid delivery pump is designed in accordance with present invention, it eliminates the disadvantages of the prior art and provides for the above mentioned highly advantageous results.

The dirt particles contained in the fluid deposit, because of their force of gravity independence of their specific density relatively fast on the passage bottom of the inventive flow passage. They are transported from here by a secondary flow which is formed in the flow passage, through the throughgoing slots on the inner passage wall, and finally are deposited under the flow passage in a deposit chamber formed on the pan bottom. The cause of the secondary flow which is formed on the merdional plane of the flow passage is the radial pressure gradient which is produced by the centrifugal force of the fluid elements in the interior of the passage. The longitudinally flowing fluid elements in the wall limiting layers are subjected to this pressure gradient and therefore transported in the interior of the passage.

In accordance with a preferable embodiment of the present invention the flow passage and the deposit chamber for the dirt particles limited by the pan bottom is formed by the wall regions of the pan bottom and the pan casing and a pan insert inserted in the interior of the pan.

A ring projection which extends on the inner wall of the tank casing to the pan bottom radially has a surface which forms the passage bottom and is formed of one piece. The insert has a flat bottom which limits the deposit chamber from above and a wall web which axially projects upwardly along the bottom edge and forms the inner passage wall of the flow passage. Since the flow passage and the deposit chamber are formed as two separately manufacturable parts, there is a substantial manufacturing advantage which lowers the production cost of the housing pan.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
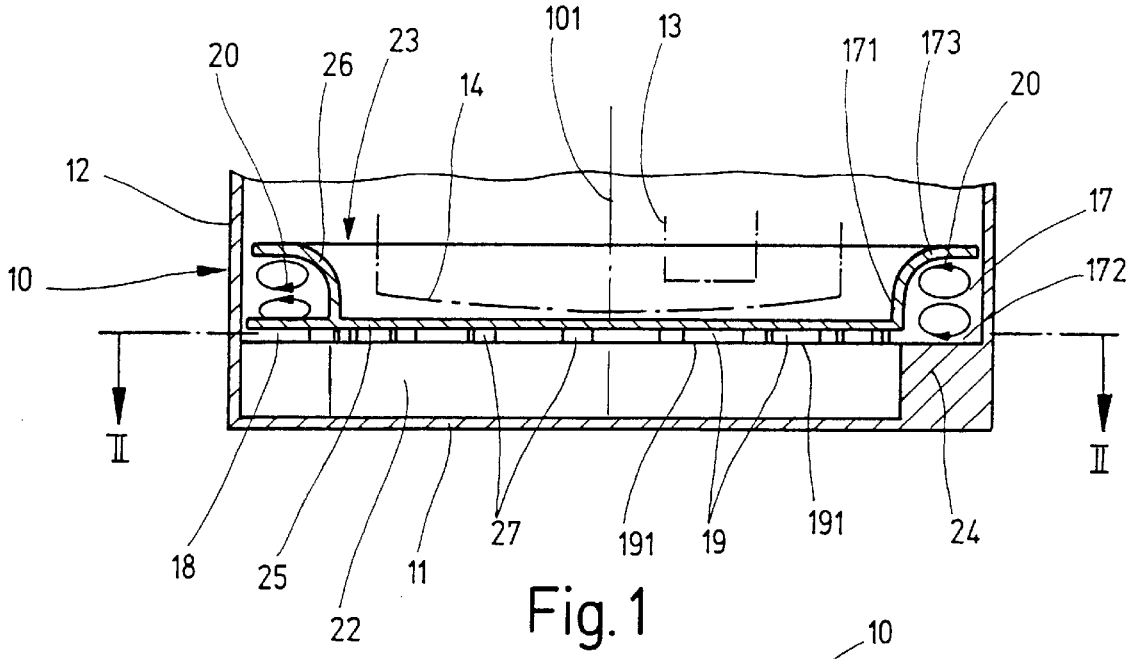
FIG. 1 is a view showing a longitudinal section of a housing pan for a fuel delivery aggregate in accordance with the present invention taken along the cutting line I—I in FIG. 2.

A housing pan 10 in accordance with present invention is shown in FIG. 1 in a longitudinal section. It operates for receiving a fluid delivery pump and also, in its preferable embodiment, a delivery aggregate for delivering fuel from a fuel tank to an internal combustion engine, which is identified as a tank insert. It includes, in addition to a housing pan, also a fuel delivery pump and a filter pan which receives the delivery pump and is provided with a prefilter and a main filter. Such a delivery aggregate is disclosed for example in the German patent document DE 44 44 854 A1. The filter pan is inserted with integrated delivery pump as well as with pre and main filter, into a housing pan 10. The thusly finished housing pan 10 is mounted in the fuel tank, so that a supply opening in the housing pan 10 makes possible the fuel flow from the fuel tank into the interior of the housing pan 10.

FIG. 1 shows a pan bottom 11 and a lower part of a cylindrical pan wall 12 of the housing pan 10. The suction pipe of the fuel delivery pump is identified as 13. A prefilter mounted at the filter cup at its end side is identified with 14. The delivery pump sucks fuel through its suction pipe 14 and the prefilter 13 from the housing pan 10 and pumps it to the internal combustion engine. There fuel which is not consumed is supplied in a known manner again to the fuel tank through fuel return conduit. The fuel return flow is used for operating a suction jet pump, with which fuel is brought from the fuel tank through the supply 15 into the housing pan 10. The fuel inflow actuated by the suction jet pump through the supply opening 15 is identified in FIG. 2 with a set of arrows 16.

In order to provide an efficient separation of dirt particles from the fuel which fills the housing pan 10 and hold them far from the prefilter 14 of the filter pan and therefore to guarantee a low dirt particle loading of the delivery pump and reduction of wear sensitivity the fuel supply is performed by the suction jet pump through a partial-ring-shaped flow passage 17 formed in the interior of the housing pan 10. The flow passage 17 is arranged concentrically to an axis 101 of the pan. The flow passage 17 is formed on the inner wall of the pan casing 12 at an axial distance from the pan bottom 11 and extends over a peripheral angle which is more than 180°. A supply opening 15 is formed at the passage entry, while the passage end opens freely into the pan interior.

Figure 2:
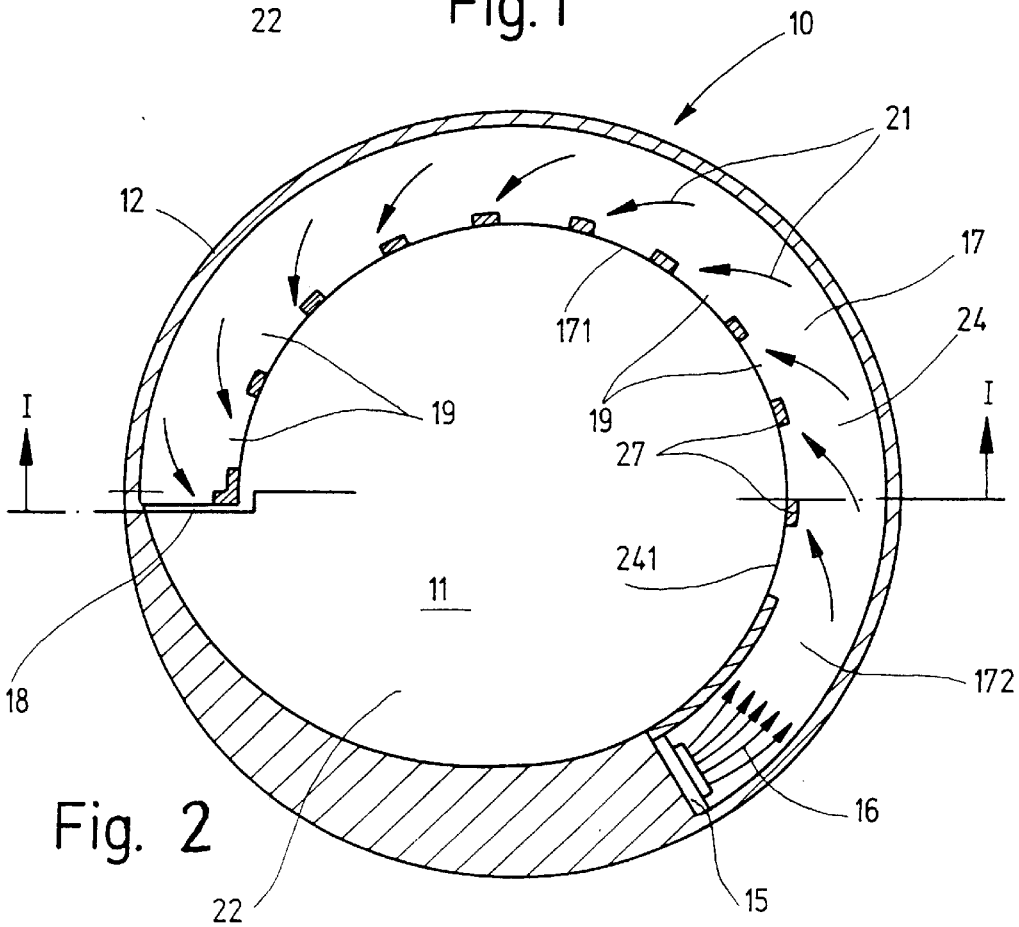
FIG. 2 is a view showing a section taken along the line II—II in FIG. 1.

As can be seen from FIGS. 1 and 2, an outlet slot 18 is formed in the passage end. It extends in the axial plane of the housing pan 10 or in an approximately parallel plane. A passage wall 171 which is located inwardly in a radial direction is provided with a plurality of throughgoing slots 19 which are spaced over the length of the passage from one another. They extend in the longitudinal direction of the passage, and their lower slot edges 191 located near the pan bottom 11 are provided directly at the passage bottom 172. As can be seen from FIG. 1, the width of the throughgoing slot 19 in direction of the pan axis 101 is very much smaller than the axial height of the flow passage 17 as seen in direction of the pan axis 101.

The dirt-loaded fuel picked up by the suction jet pump is supplied through the curved flow passage 17 to the outlet slot 18. Because of the passage curvature a pronounced secondary flow is produced in the meridional plane as identified with the arrows 20 in FIG. 1. The cause of the secondary flow is the radial pressure gradient which is caused by the centrifugal force of the fluid elements in the interior of the passage. The slowly flowing fuel elements in the wall limiting layers are subjected to this pressure gradient and thereby transported to the interior of the passage. The dirt particles which are available in the entering fuel jet with a density greater than 1.5 kg/dm$^3$ are deposited, due to the force of gravity in dependence on the density relatively fast on the passage bottom 172. From there, the dirt particles, because of the secondary flow, are withdrawn through the throughgoing slots 19 into an inwardly located deposit chamber 22 and therefore no longer can reach the prefilter 14 of the delivery pump. The wall-close flow line coarse in the flow passage 17 is identified in FIG. 2 by the arrow 21. The deposit chamber 22 is located due to the formation of the flow passage 17 at an axial distance from the pan bottom 11 and is limited from below by the pan bottom 11.

In all embodiments of the housing pan 10, the flow passage 17 on the one hand and the deposit chamber 22 on the other hand are formed by wall regions of the pan bottom 11 and the pan casing 12 as well as by wall regions of a pan insert 23 inserted in the interior of the pan. For this purpose a radially inwardly projecting ring projection 24 which is provided on the inner wall of the pan casing 12 and extends to the pan bottom 11 is formed as a one-piece element. Its surface which faces away from the pan bottom 11 forms the passage bottom 172. The ring projection 24 extends with the constant radial width with the same peripheral angle as the flow passage 17. At the passage end, the radial width for forming the outlet slot 18 is very small, in order to maintain the predetermined constant radial width again at the canal entry. An axially upwardly projecting web portion 27 extends along the circular-ring-shaped upper inner edge 241 of the ring projection 24 which faces away from the pan bottom 11. It is located in the region of the flow passage 17 and is formed as once-piece element. The web portions are spaced from one another along the length of the throughgoing slot 19 at a predetermined distance and are formed so that they are flush with the inner edge 241.

Figure 3:
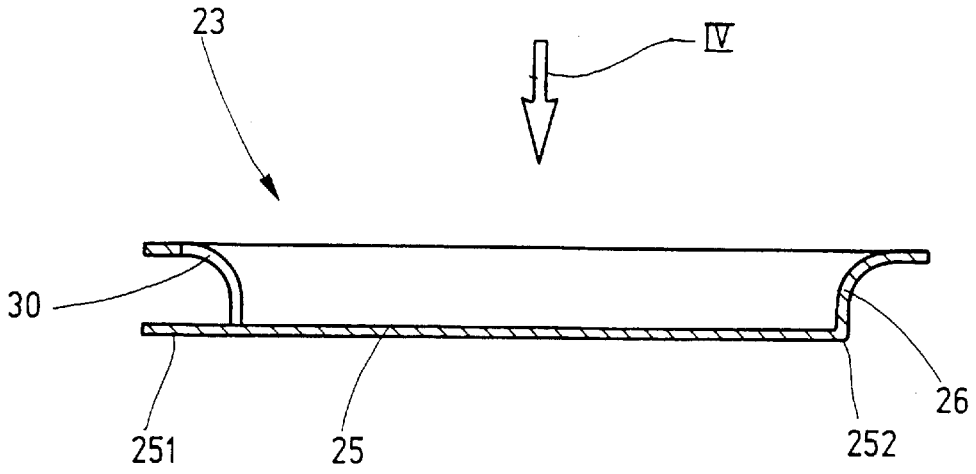
FIG. 3 is a section through a pan insert inserted in the interior of the pan taken along the line III—III in FIG. 4.
Figure 4:
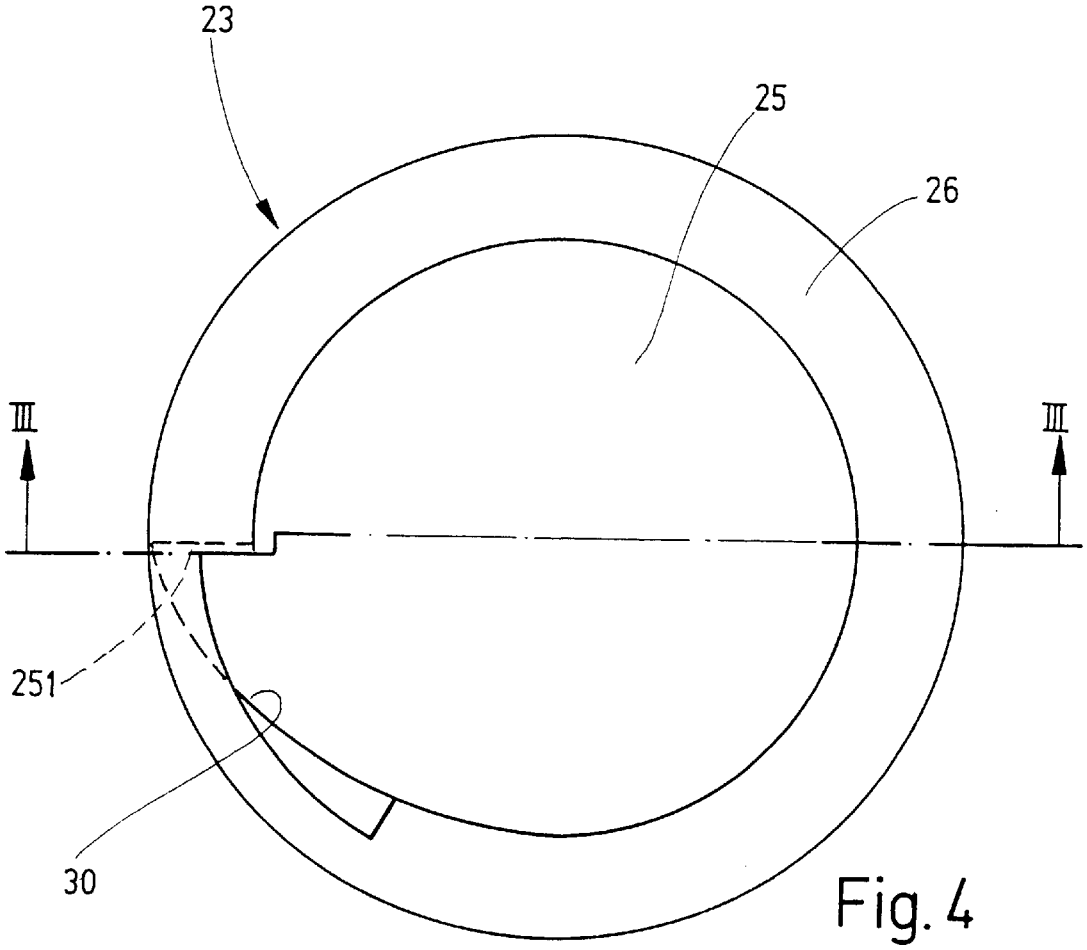
FIG. 4 is a plan view of the insert as seen in direction of the arrow 4 in FIG. 3.

The top insert 23 which is shown in FIG. 3 in section and in FIG. 4 on plan view, separately from the housing pan has a flat bottom 25 and a wall web 26 which projects axially and upwardly along the outer bottom edge 252. It is curved outwardly so that the end of the wall web 26 lies on an outer diameter which is smaller than the inner diameter of the pan casing 12. While the pan insert 23 is rotation-symmetrical relative to its wall web 26, the bottom 25 in the region of the outlet slot 18 has a lug-shaped projection 251 as identified with broken contour in FIG. 4.

In the region of the wall web 26 which follows the projection 251, a throughgoing opening 30 is provided so that the ring passage flow can reach the inner region of the pan insert 23 which is limited by the bottom 25 and the wall web 26. After insertion of the pan insert 23 into the housing pan 10, the flat bottom 25 of the pan insert 23 limits the deposit chamber 22 from above. The curved wall web 26 extending approximately with a gap distance to the inner wall of the pan casing 12 forms an inner passage wall 171 and an upper wall region 173 of the flow passage 17. Thereby, a flow passage 17 is produced so that it is substantially closed around and has a supply opening 15 the outlet slot 18, and the throughgoing slots 19 provided on the inner passage wall for the dirt particle withdrawal in the deposit chamber 22. The throughgoing slots 19 are defined by web portions 27 on the ring projection 24 and by the bottom 25 of the pan insert 23 sitting on the ring projection 24.

Figure 5:
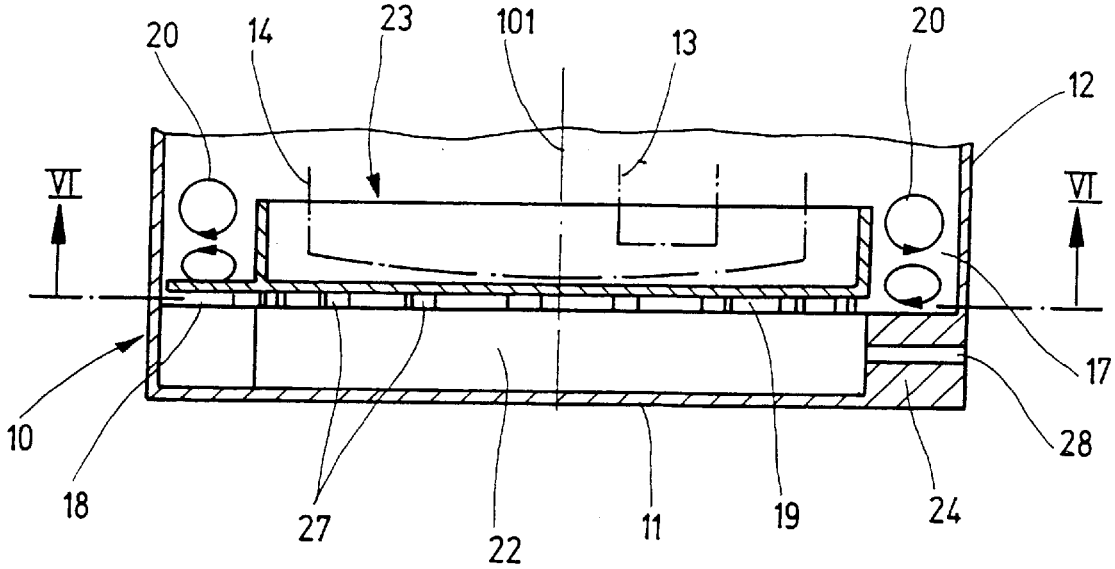
FIGS. 5 and 6 are views substantially corresponding to the views of FIGS. 1 and 2 but showing a housing pan in accordance with a second embodiment of the present invention.
Figure 6:
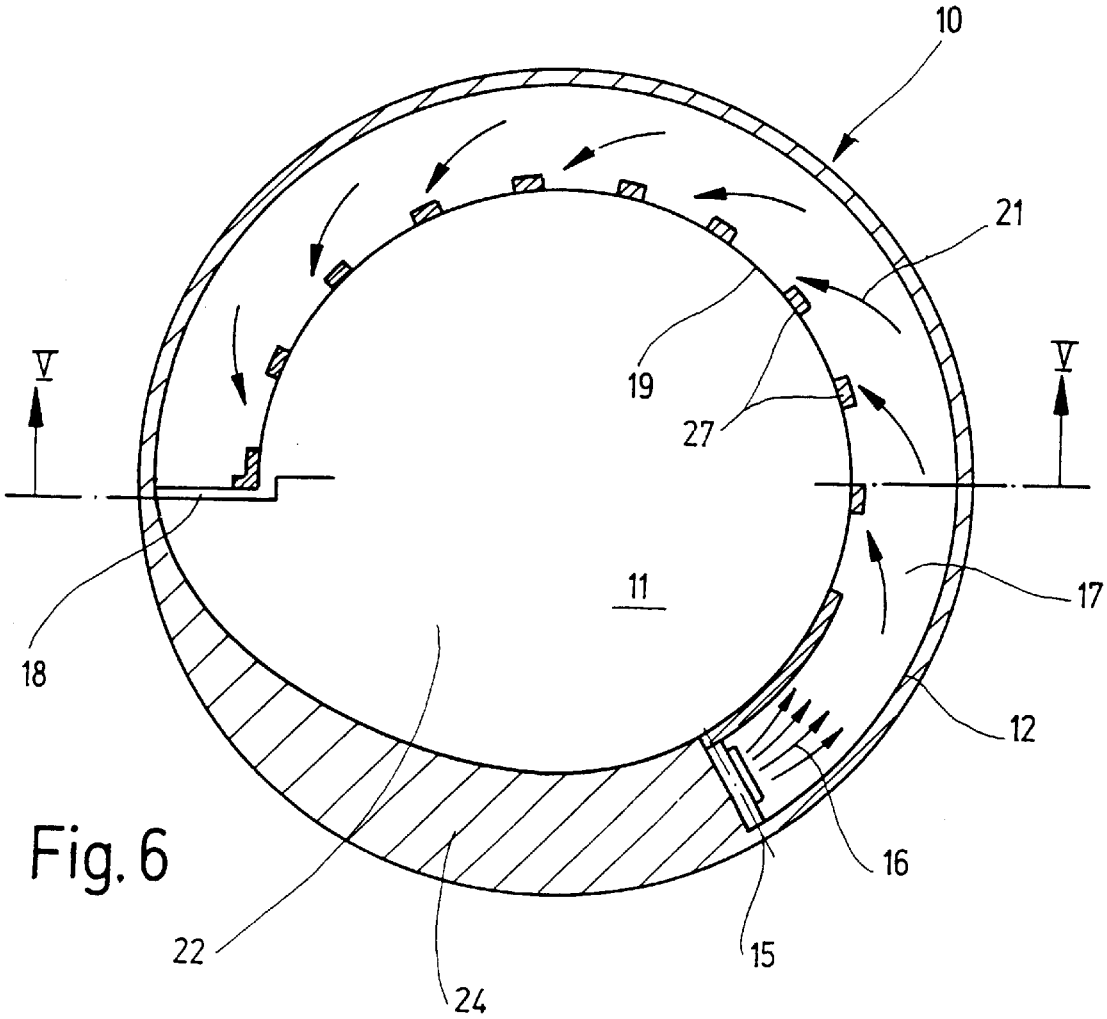
Figure 7:
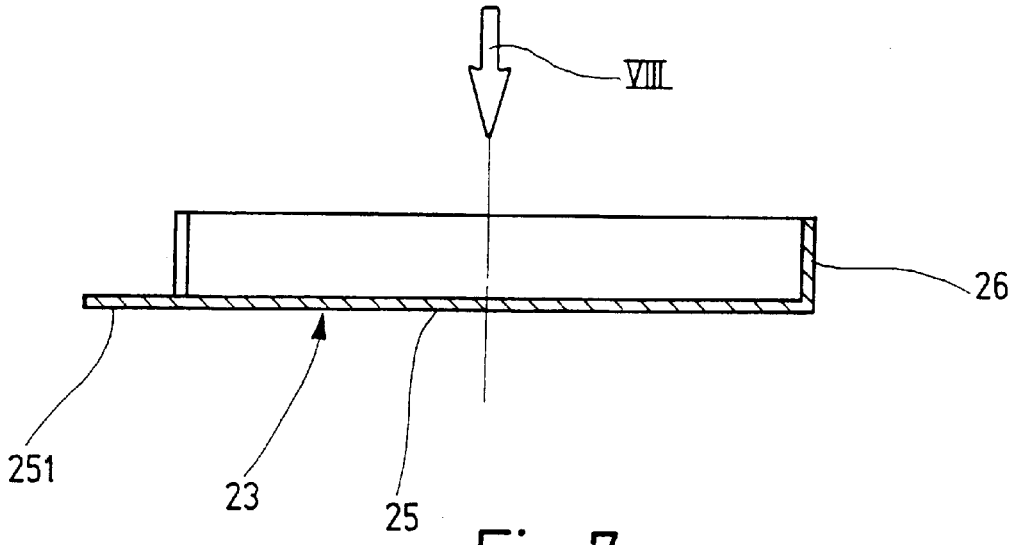
FIG. 7 is a section of the pan insert of FIG. 5 taken along the line VII—VII in FIG. 8.
Figure 8:
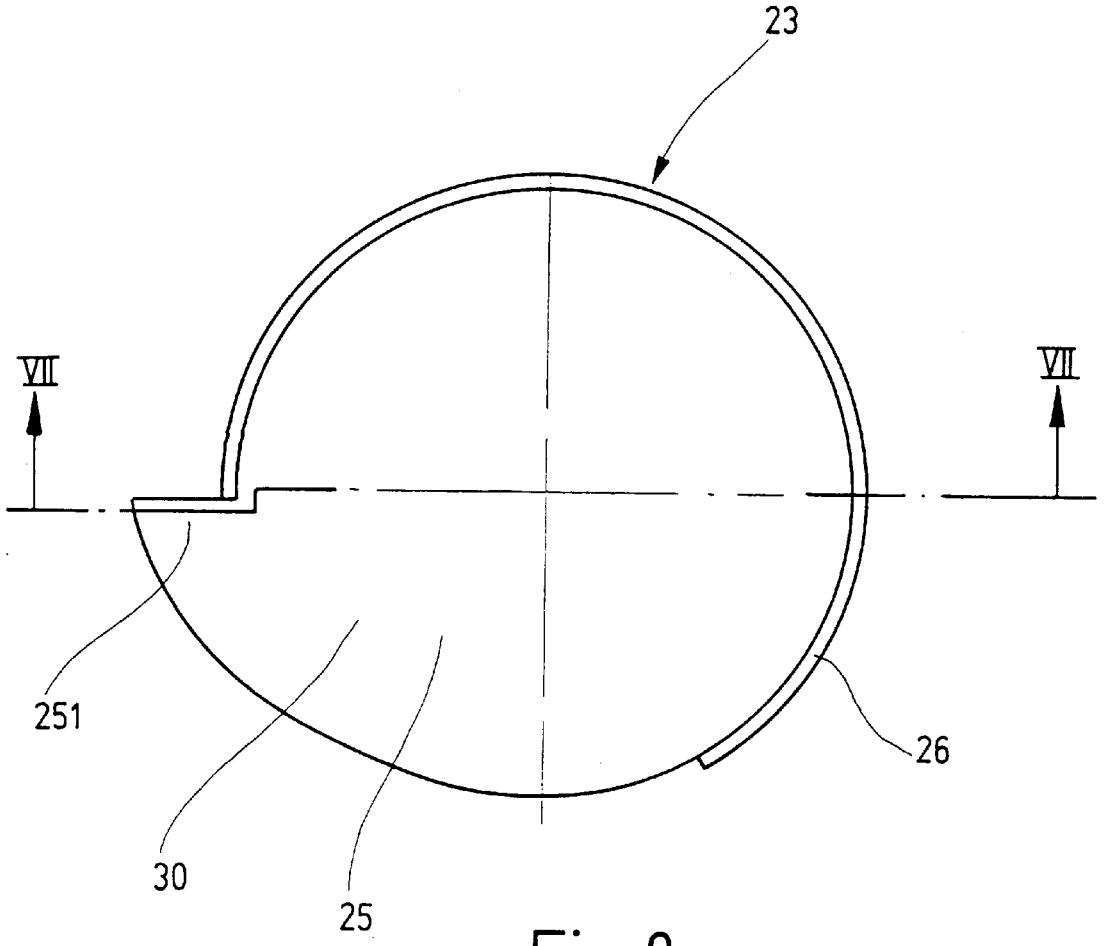
FIG. 8 is a plan view of the pan insert as seen in direction of the arrow 8 in FIG. 7.

The embodiment shown in FIGS. 5 and 6 deals with a modified housing pan 10 which differs in that the flow passage 17 is not closed, but instead is upwardly open. Thereby a weakened secondary flow is produced in the flow passage 17 as identified with arrow 20. For reinforcement of the carrying away mechanism for the dirt particles contained in the fuel, a throttle 28 formed as a single opening is provided in the deposit chamber 22. Therefore a flow is set between the interior of the pan and the surrounding area of the pan, or in other words the fuel tank. The flow passage 17 is formed by means of the pan insert 22, whose ring-shaped wall web 26 extends only in the axial direction and no longer has a curvature leading toward the pan casing 12. The flat pan bottom 25 also has the lug-shaped projection 251 in the region of the outlet slot 18. The construction of the pan insert 23 with the throughgoing opening 30 in the region of the wall web 26 extending on the projection 251 is shown in FIGS. 7 and 8. As for the remaining aspects, the housing pan 10 of FIGS. 5 and 6 corresponds to the housing pan of FIGS. 1 and 2, so that identical components are identified with the same reference numerals.

Figure 9:
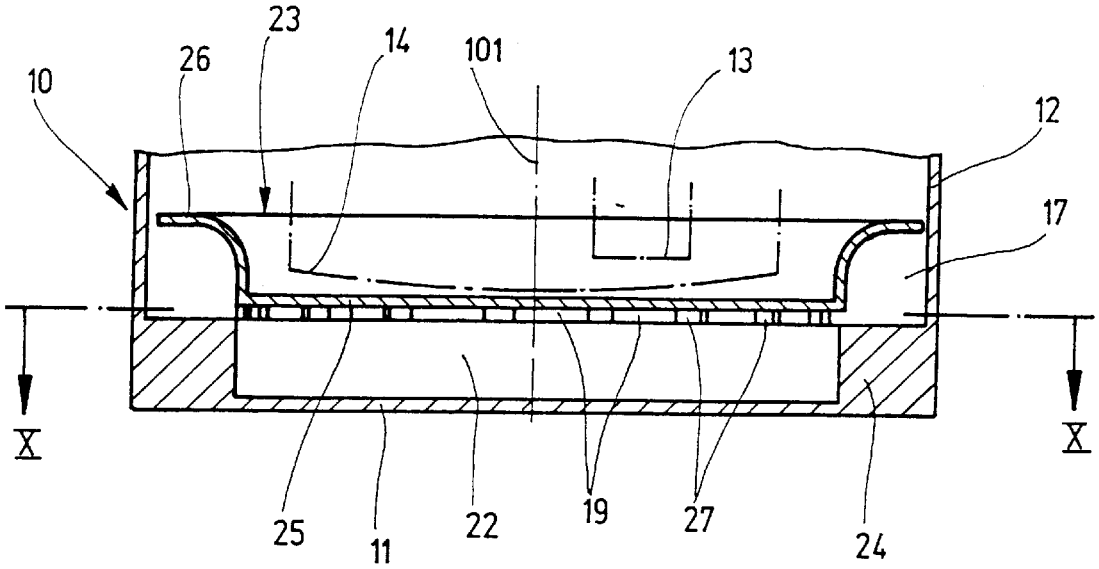
FIGS. 9 and 10 are views substantially corresponding to the views of FIGS. 1 and 2 but showing a third embodiment of the present invention.
Figure 10:
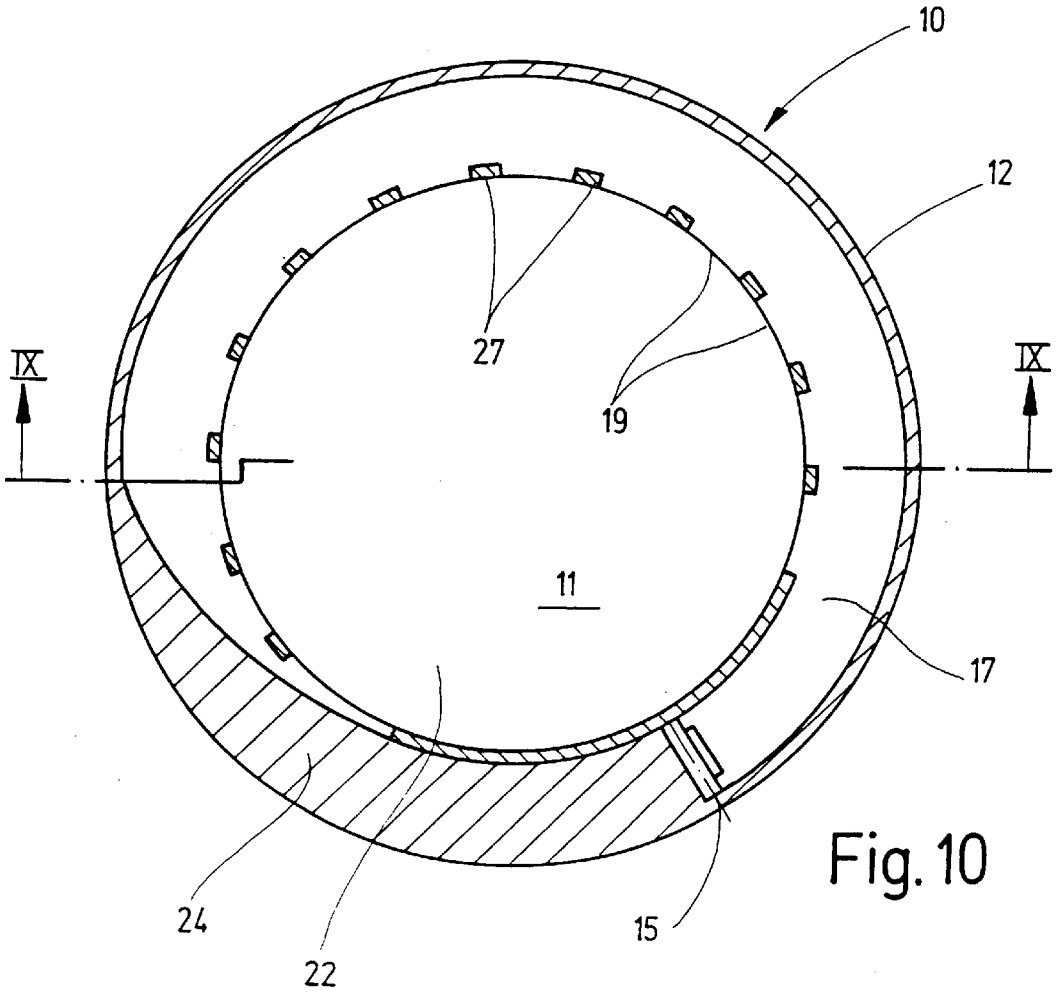
Figure 11:
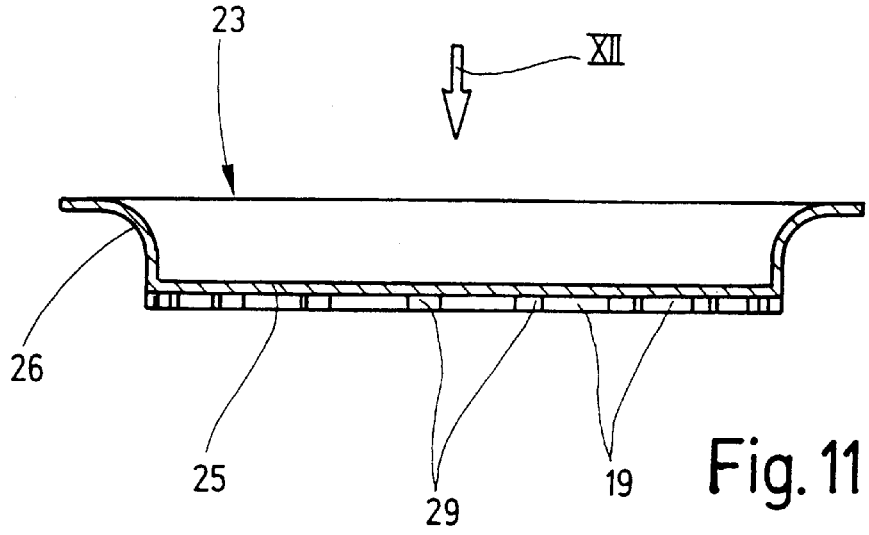
FIG. 11 is view showing a section of the pan insert of FIG. 9 taken along the line XI—XI in FIG. 12.
Figure 12:
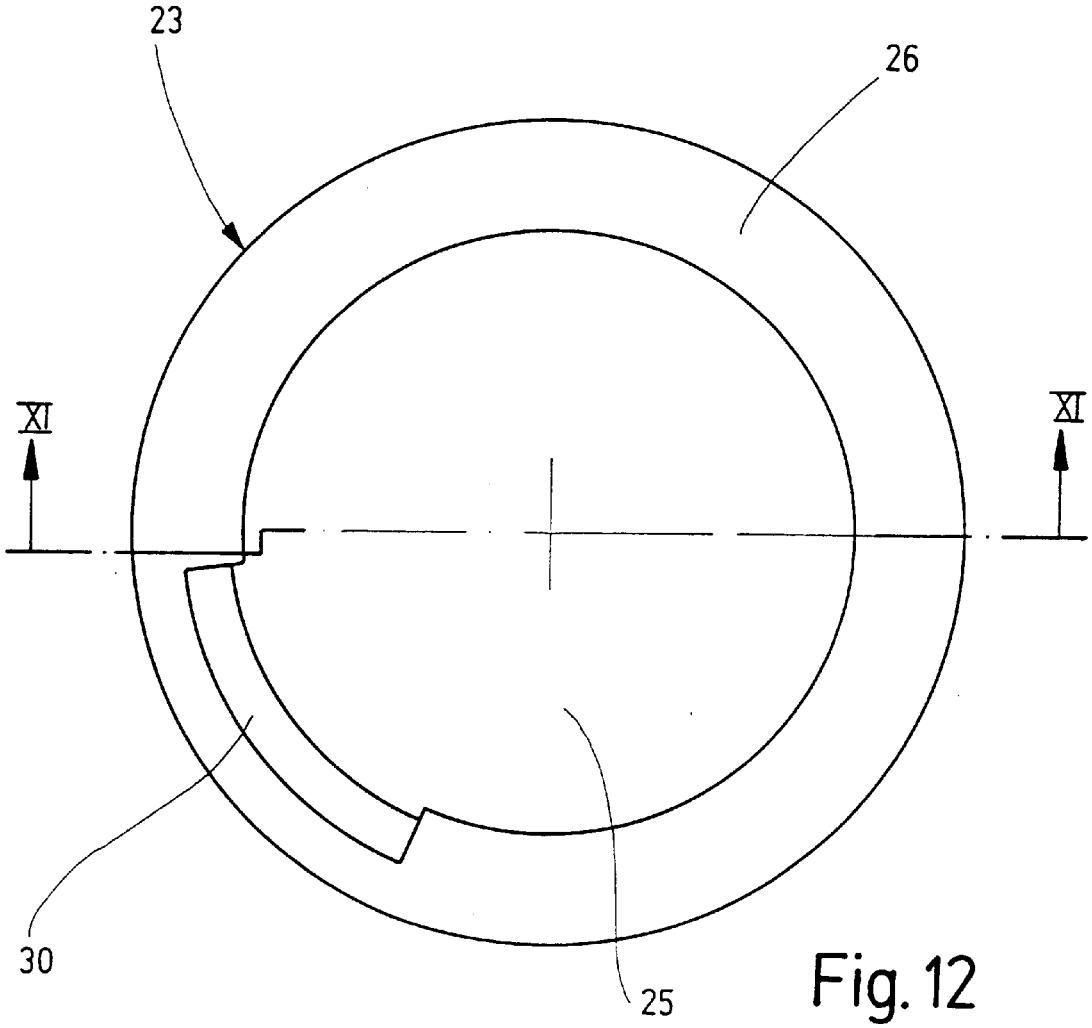
FIG. 12 is a plan view of the pan insert as seen in direction of the arrow 12 in FIG. 11.

The embodiment of the housing pan 10 shown in FIGS. 9 and 10 differs from the housing pan 10 of FIGS. 1 and 2 in that the meridional outlet slot 18 at the passage is dispensed with. Therefore here both the ring projection 24 and also the pan insert 23 shown in FIGS. 11 and 12 are formed as rotation-symmetrical shapes. The bottom of the pan insert 23 is identified as 25, the wall web as 26, and the throughgoing opening for the ring passage flow available in the wall web 26 is identified as 30. Moreover, the throughgoing slots 19 in the inwardly located passage wall are not at the pan side, but instead are located at the insert side. For this purpose, web portions 29 are formed of one piece at the lower side of the bottom 25 of the pan insert 23 along the outer bottom edge in FIG. 11. The web portions 29 are spaced from one another and located flush with the circular-ring shape bottom edge. The web portions 29 together with the outer surface of the ring projection 24 limit the throughgoing slot 19. The throttle 28 for reinforcing the carrying away mechanism for the dirt particles shown in FIG. 5 can be provided both in the embodiment in FIGS. 9 and 10 and in the embodiment of FIGS. 1 and 2.

It will be understood that each of the elements described above, or two or more together, may also find a useful application in other types of constructions differing from the types described above.

While the invention has been illustrated and described as embodied in housing pan for supporting a fluid delivery pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

We claim:

1. A housing pan for receiving a fluid delivery pump for delivery aggregate for delivering fuel from a fuel tank, comprising a pan body having a pan bottom; a supply opening for flowing fluid and open for flowing fluid and open into an interior of said pan body; a part-ring shaped flow passage located concentrically to an axis of said pan body in said interior of said pan body at an axial distance from said pan bottom, said flow passage having a passage entry which communicates with said supply opening and also having a passage wall which is located inwardly in a radial direction and is provided with a plurality of throughgoing slots, said throughgoing slots being spaced from one another over a length of said flow passage and extending in a longitudinal direction of said flow passage, said throughgoing slots having a lower slot edges located closer to said pan bottom and arranged at least near a passage bottom.

2. A housing pan as defined in claim 1, wherein said lower slot edges are arranged at said passage bottom.

3. A housing pan as defined in claim 1, wherein said throughgoing slots have an axial width as seen in direction of the pan axis, which is substantially smaller than an axial height of said flow passage as seen in a direction of said pan axis.

4. A housing pan as defined in claim 1, wherein said flow passage is circumferentially close.

5. A housing pan as defined in claim 1, wherein said flow passage is open only at a side which faces away from the passage bottom.

6. A housing pan as defined in claim 1, wherein said flow passage has a passage end provided with an outlet slot which extends in an axial plane of said pan body.

7. A housing pan as defined in claim 1, wherein said flow passage has a passage end provided with an outlet slot which extends substantially parallel to a plane of said pan body.

8. A housing pan as defined in claim 1, wherein said pan body has a cylindrical pan casing, said flow passage extending along an inner wall of said cylindrical pan casing at an angle of more than 180°.

9. A housing pan as defined in claim 1; further comprising a deposit chamber formed under said flow passage and limited by said pan bottom, said deposit chamber communicating through said throughgoing slots with an interior of said flow passage.

10. A housing pan as defined in claim 1, wherein said throughgoing slots of said passage wall are arranged at a side of said pan body.

11. A housing pan as defined in claim 9; and further comprising a pan inserted in the interior of said pan body; said flow passage and said deposit chamber being formed by wall regions of said pan bottom of said pan casing and said pan insert.

12. A housing pan as defined in claim 11, wherein said pan casing has an inner wall provided with a ring projection which extends to said pan bottom radially inwardly and is formed of one piece with said inner wall.

13. A housing pan as defined in claim 12, and further comprising web portions which extend along an upper inner edge of said ring projection facing away from said pan bottom are flush with said ring projection and spaced from one another, and are formed of one piece with said ring projection, said web portions extending axially and defining a throughgoing slot together with a bottom of said pan insert.

14. A housing pan as defined in claim 13, and further comprising further web portions provided on a lower side of said bottom of said pan insert along an outer edge of said pan insert, said further web portions are flush being flush with said pan insert and being spaced from one another and formed of one piece with said pan insert, said further web portions extending axially and defining a throughgoing slot together with an outer surface of said ring projection.

15. A housing pan as defined in claim 12, wherein said ring projection has a throttle opening which is open in said deposit chamber and also at an outer side of said pan casing.

16. A housing pan as defined in claim 11, wherein said pan insert has a flat bottom which limits upwardly said deposit chamber and has an upwardly projecting wall web extending along an edge of said flat bottom, said wall web forming an inner passage wall of said flow passage and having a throughgoing opening arranged behind an end of said flow passage.

17. A housing pan as defined in claim 16, wherein said wall web is curved arcuately outwardly and extends close to an inner wall of said pan casing to form an upper wall region of said flow passage.

18. A housing pan as defined in claim 11, wherein said throughgoing slots of said inner passage wall are arranged at a side of said pan insert.

* * * * *